US010343889B2

(12) United States Patent
Hense

(10) Patent No.: US 10,343,889 B2
(45) Date of Patent: Jul. 9, 2019

(54) FLUID PUMPING ASSEMBLY

(71) Applicant: Nicole Hense, Saint Louis, MO (US)

(72) Inventor: Nicole Hense, Saint Louis, MO (US)

( * ) Notice: Subject to any disclaimer, the term of this patent is extended or adjusted under 35 U.S.C. 154(b) by 0 days.

(21) Appl. No.: 15/724,789

(22) Filed: Oct. 4, 2017

(65) Prior Publication Data

US 2019/0100424 A1 Apr. 4, 2019

(51) Int. Cl.
*B67D 7/02* (2010.01)
*B65D 83/00* (2006.01)

(52) U.S. Cl.
CPC ..... *B67D 7/0205* (2013.01); *B65D 83/00* (2013.01)

(58) Field of Classification Search
CPC .... B67D 7/0205; B67D 1/0802; B65D 83/00; B05B 15/30
USPC ..... 222/321.1, 321.7–321.9, 383.1, 383.3, 222/464.1, 464.7, 185.1, 255, 257, 265
See application file for complete search history.

(56) References Cited

U.S. PATENT DOCUMENTS 597,408 A 1/1898 Goldsmith
3,062,416 A * 11/1962 Cooprider ..... B05B 11/0064 222/153.13
4,913,319 A * 4/1990 Root ..... A47K 5/03 222/135
5,405,057 A * 4/1995 Moore ..... B05B 11/3023 222/153.13
5,413,251 A * 5/1995 Adamson ..... A47K 5/1211 222/129
5,421,488 A 6/1995 Ehrbar
5,482,172 A 1/1996 Braddock
5,636,767 A 6/1997 Vogrin
7,823,539 B2 11/2010 Keller et al.
2005/0167527 A1* 8/2005 Iiood ..... B05B 11/0037 239/302
2006/0102654 A1 5/2006 Seys et al.
2009/0045226 A1* 2/2009 Munlin ..... B67D 7/00 222/158
2009/0242588 A1 10/2009 Olson

FOREIGN PATENT DOCUMENTS

EP 0379627 A1 * 8/1990 ..... B05B 11/3084
WO WO2009123885 10/2009

* cited by examiner

*Primary Examiner* — Donnell A Long

(57) ABSTRACT

A fluid pumping assembly includes a bottle that may contain a fluid. A first pump is movably coupled to the bottle and the first pump is selectively manipulated. The first pump is in fluid communication with the interior of the bottle to selectively urge the fluid outwardly from the bottle. A second pump is movably coupled to the bottle and the second pump is selectively manipulated. The second pump is in fluid communication with the interior of the bottle to selectively urge the fluid outwardly from the bottle. The second pump is spaced from the first pump to draw fluid from the bottom of the bottle.

9 Claims, 4 Drawing Sheets

FLUID PUMPING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including information disclosed under 37 CFR 1.97 and 1.98.

The disclosure and prior art relates to pumping devices and more particularly pertains to a new pumping device for pumping an entire volume of fluid from a bottle.

BRIEF SUMMARY OF THE INVENTION

An embodiment of the disclosure meets the needs presented above by generally comprising a bottle that may contain a fluid. A first pump is movably coupled to the bottle and the first pump is selectively manipulated. The first pump is in fluid communication with the interior of the bottle to selectively urge the fluid outwardly from the bottle. A second pump is movably coupled to the bottle and the second pump is selectively manipulated. The second pump is in fluid communication with the interior of the bottle to selectively urge the fluid outwardly from the bottle. The second pump is spaced from the first pump to draw fluid from the bottom of the bottle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
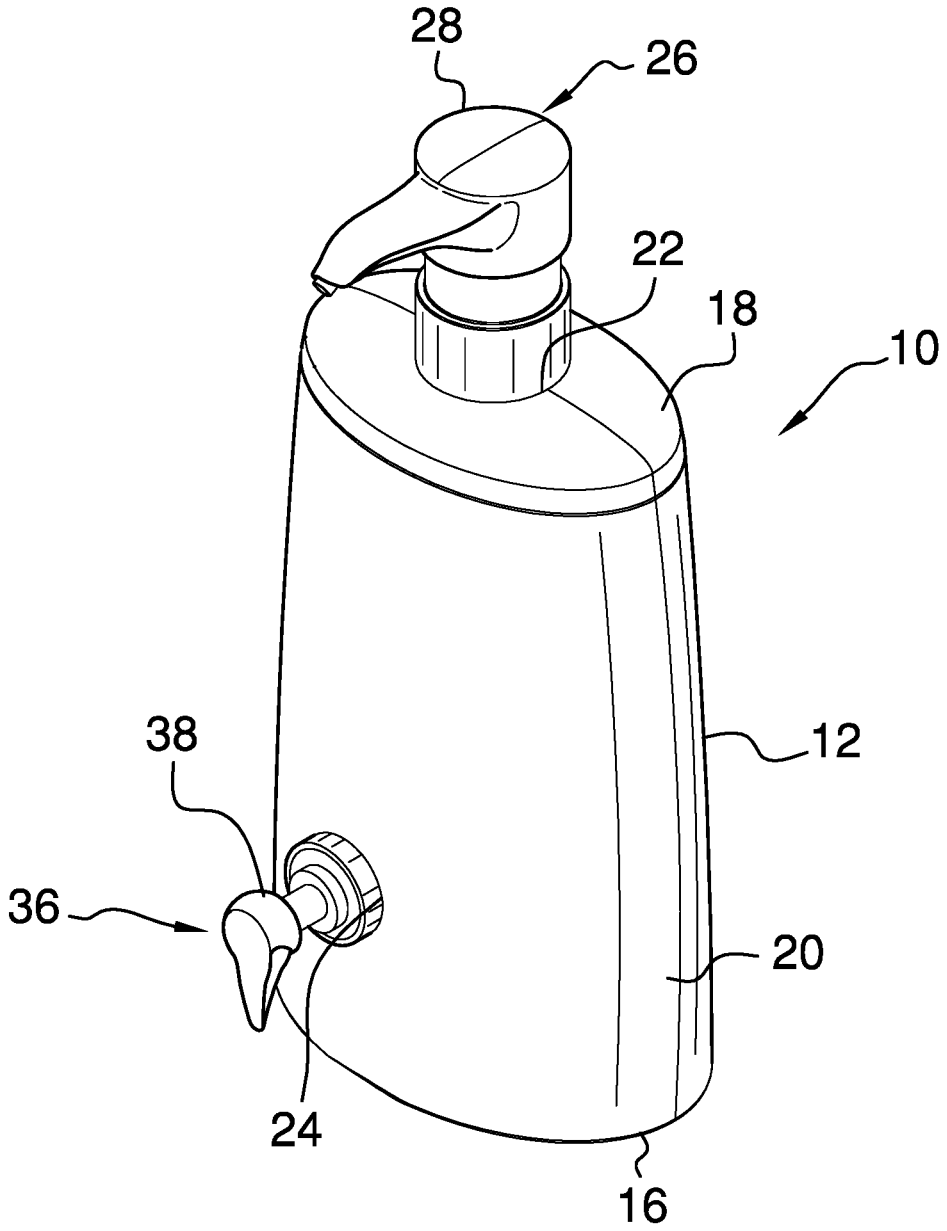
FIG. 1 is a top perspective view of a fluid pumping assembly according to an embodiment of the disclosure.
Figure 2:
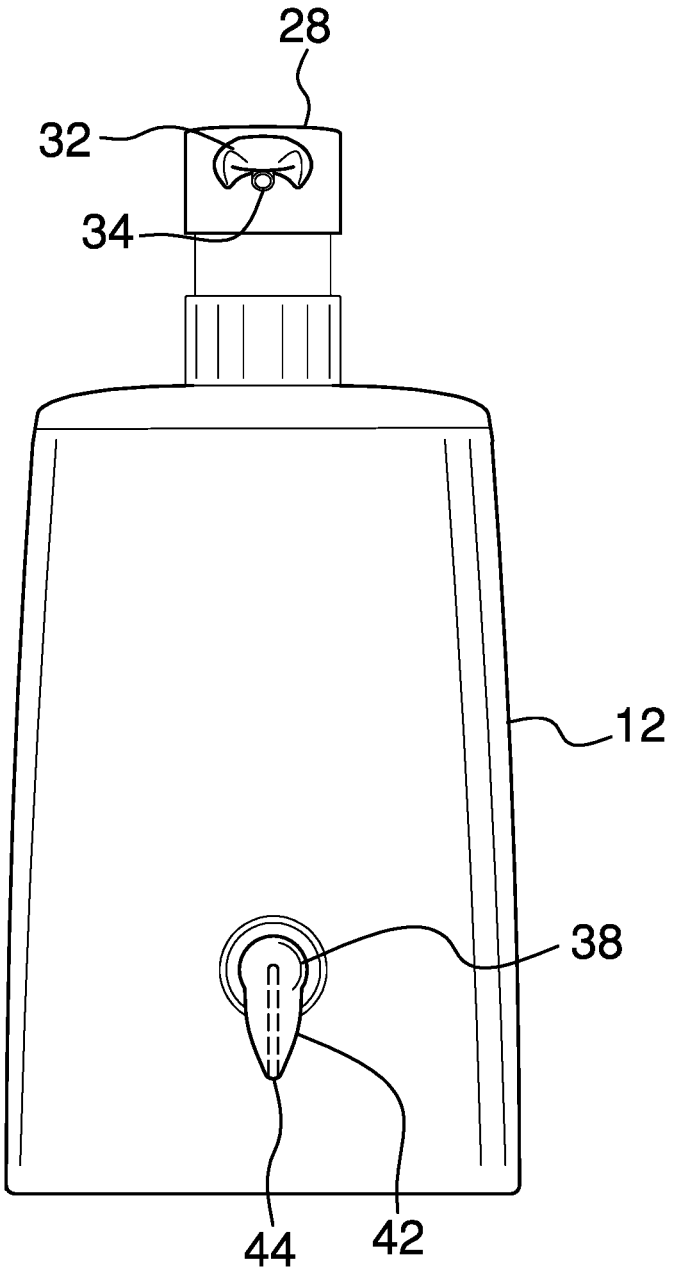
FIG. 2 is a front view of an embodiment of the disclosure.
Figure 4:
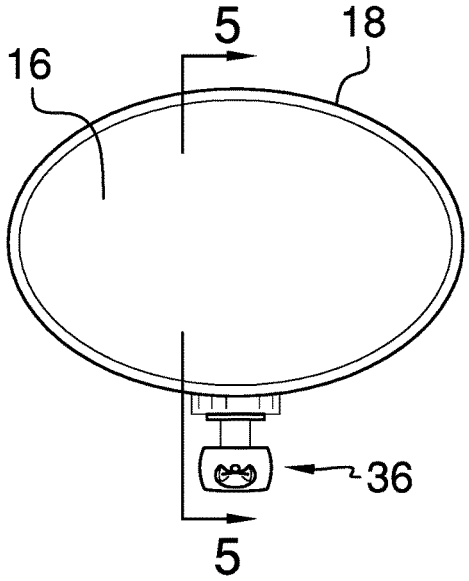
FIG. 4 is a bottom view of an embodiment of the disclosure.
Figure 3:
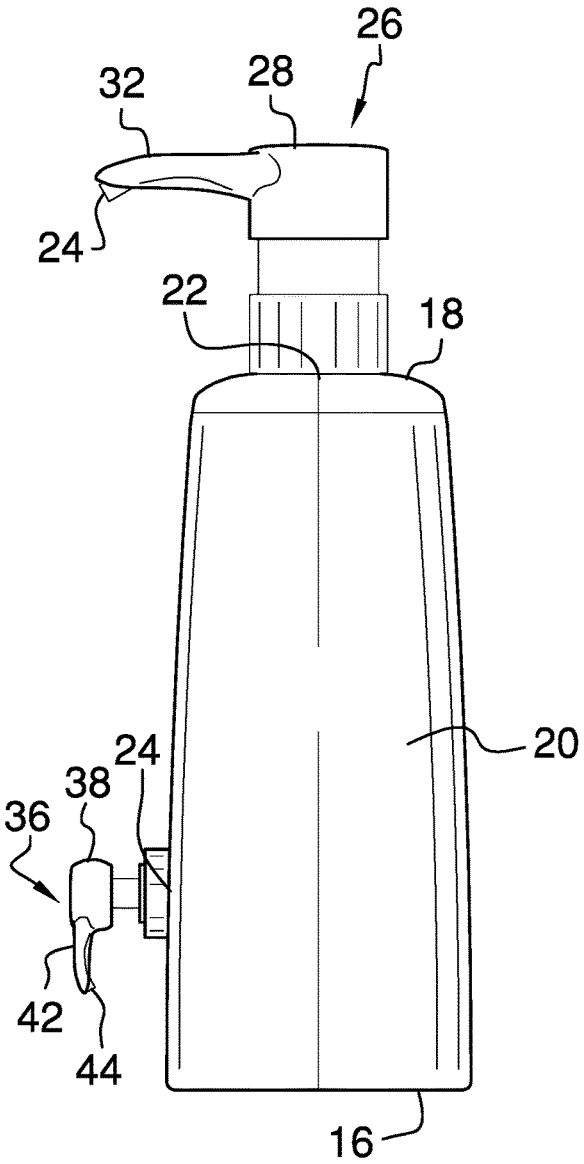
FIG. 3 is a left side view of an embodiment of the disclosure.
Figure 5:
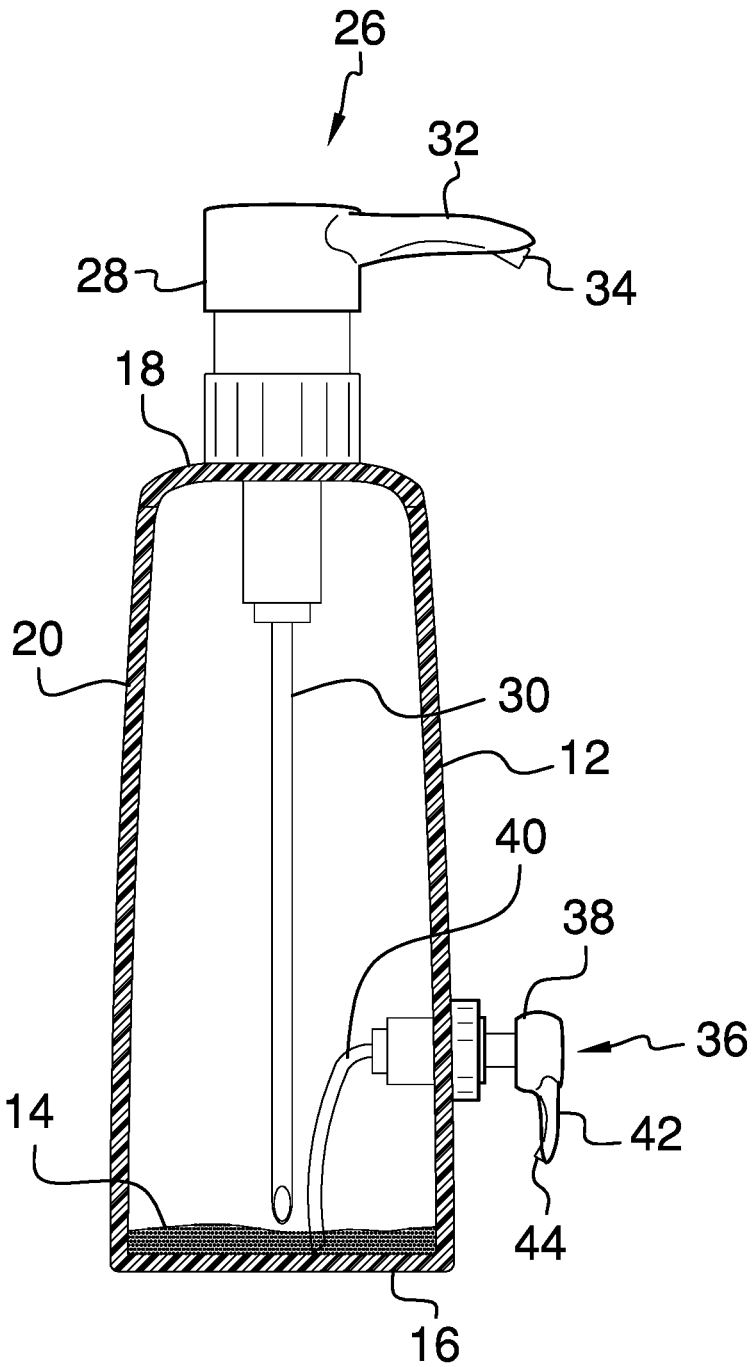
FIG. 5 is a cross sectional view taken along line 5-5 of figure of an embodiment of the disclosure.

With reference now to the drawings, and in particular to FIGS. 1 through 5 thereof, a new pumping device embodying the principles and concepts of an embodiment of the disclosure and generally designated by the reference numeral 10 will be described.

As best illustrated in FIGS. 1 through 5, the fluid pumping assembly 10 generally comprises a bottle 12 that may contain a fluid 14. The fluid 14 may be hand lotion, hand soap and any other fluid 14. The bottle 12 has a bottom wall 16, a top wall 18 and an outer wall 20 extending therebetween. The top wall 18 has a first opening 22 extending into an interior of the bottle 12. The outer wall 20 has a second opening 24 extending into the interior of the bottle 12. Additionally, the second opening 24 is positioned closer to the bottom wall 16 than the top wall 18. The top wall 18 of the bottle 12 may be removably coupled to the outer wall 20 for refilling the bottle 12.

A first pump 26 is movably coupled to the bottle 12 and the first pump 26 is selectively manipulated. The first pump 26 is in fluid 14 communication with the interior of the bottle 12 to selectively urge the fluid 14 outwardly from the bottle 12. The first pump 26 may be a manually operated fluid 14 pump or the like. The first pump 26 comprises a first plunger 28 that is removably coupled to the top wall 18 of the bottle 12. The first plunger 28 is selectively urged downwardly on the bottle 12 to create suction. Moreover, the first plunger 28 extends into the first opening 22 in the bottle 12.

A first tube 30 is fluidly coupled to the first plunger 28 and extends downwardly into the interior of the bottle 12. The first tube 30 draws the fluid 14 inwardly therein when the first plunger 28 is urged downwardly. A first spout 32 is coupled to the first plunger 28 and the first spout 32 has a distal end 34 with respect to the first plunger 28. The distal end 34 is open to dispense the fluid 14 outwardly therefrom when the first plunger 28 is urged downwardly.

A second pump 36 is movably coupled to the bottle 12 and the second pump 36 is selectively manipulated. The second pump 36 is in fluid 14 communication with the interior of the bottle 12 to selectively urge the fluid 14 outwardly from the bottle 12. The second pump 36 is spaced from the first pump 26 and the second pump 36 may comprise a manually operated fluid pump or the like. The second pump 36 comprises a second plunger 38 that is removably coupled to the outer wall 20 of the bottle 12. The second plunger 38 is selectively urged laterally toward the outer wall 20 to create suction. The second plunger 38 extends into the second opening 24.

A second tube 40 is fluidly coupled to the second plunger 38 and extends inwardly into the bottle 12. The second tube 40 draws the fluid 14 inwardly therein when the second plunger 38 is urged toward the outer wall 20. Additionally, the second tube 40 curves downwardly from the second plunger 38 to the bottom wall 16 of the bottle 12. In this way the second tube 40 may draw the entire volume of the fluid 14 outwardly from the bottle 12 when a level of the fluid 14 is below the first tube 30.

A second spout 42 is fluidly coupled to the second plunger 38. The second spout 42 has a distal end 44 with respect to the second plunger 38. Moreover, the distal end 44 of the second spout 42 is open. The distal end 44 of the second spout 42 dispenses the fluid 14 outwardly therefrom when the second plunger 38 is urged toward the outer wall 20.

In use, the first plunger 28 is selectively urged downwardly to dispense the fluid 14 outwardly from the first spout 32. The second plunger 38 is selectively urged downwardly to dispense the fluid 14 outwardly from the second spout 42. Additionally, second plunger 38 is selectively urged downwardly when the level of fluid 14 in the bottle 12 becomes too low for the first tube 30 to draw the fluid 14 inwardly therein. In this way the entire volume of the fluid 14 in the bottle 12 may be urged outwardly from the bottle 12 for use. The top wall 18 of the bottle 12 may be selectively removed to refill the bottle 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fluid pumping assembly having a pair of pumps wherein said assembly is configured to selectively dispense an entire volume of fluid from a container, said assembly comprising:

a bottle being configured to contain a fluid, said bottle having a bottom wall, a top wall and an outer wall extending therebetween, said top wall having a first opening extending into an interior of said bottle, said outer wall having a second opening extending into said interior of said bottle, said second opening being positioned closer to said bottom wall than said top wall;

a first pump being movably coupled to said top wall of said bottle wherein said first pump is configured to be manipulated, said first pump being in fluid communication with said interior of said bottle through said first opening wherein said first pump is configured to selectively urge the fluid outwardly from said bottle; and a second pump being movably coupled to said outer wall of said bottle wherein said second pump is configured to be manipulated, said second pump being in fluid communication with said interior of said bottle through said second opening wherein said second pump is configured to selectively urged the fluid outwardly from said bottle, said second pump being vertically spaced downwardly from said first pump wherein said second pump is configured to draw the fluid from a bottom of said bottle.

2. The assembly according to claim 1, wherein said first pump comprises a first plunger being removably coupled to said top wall of said bottle wherein said first plunger is configured to be selectively urged downwardly on said bottle, said first plunger extending into said first opening in said bottle.

3. The assembly according to claim 2, further comprising a first tube being fluidly coupled to said first plunger and extending downwardly into said interior of said bottle wherein said first tube is configured to selectively draw the fluid inwardly therein when said first plunger is urged downwardly, a bottom end of said first tube being spaced from a bottom surface of said interior of said bottle.

4. The assembly according to claim 3, further comprising a first spout being coupled to said first plunger, said first spout having a distal end with respect to said first plunger, said distal end being open, wherein said distal end is configured to dispense the fluid outwardly therefrom when said first plunger is urged downwardly.

5. The assembly according to claim 1, wherein said second pump comprises a second plunger being removably coupled to said outer wall of said bottle wherein said second plunger is configured to be selectively urged laterally toward said outer wall, said second plunger extending into said second opening.

6. The assembly according to claim 5, further comprising a second tube being fluidly coupled to said second plunger and extending inwardly into said bottle wherein said second tube is configured to draw the fluid inwardly therein when said second plunger is urged toward said outer wall.

7. The assembly according to claim 6, wherein said second tube curves downwardly from said second plunger to said bottom wall of said bottle wherein said second tube is configured to draw the entire volume of the fluid outwardly from said bottle.

8. The assembly according to claim 6, further comprising a second spout being fluidly coupled to said second plunger, said second spout having a distal end with respect to said second plunger, said distal end of said second spout being open, wherein said distal end of said second spout is configured to dispense the fluid outwardly therefrom when said second plunger is urged toward said outer wall.

9. A fluid pumping assembly having a pair of pumps wherein said assembly is configured to selectively dispense an entire volume of fluid from a container, said assembly comprising:

a bottle being configured to contain a fluid, said bottle having a bottom wall, a top wall and an outer wall extending therebetween, said top wall having a first opening extending into an interior of said bottle, said outer wall having a second opening extending into said interior of said bottle, said second opening being positioned closer to said bottom wall than said top wall;

a first pump being movably coupled to said top wall of said bottle wherein said first pump is configured to be manipulated, said first pump being in fluid communication with said interior of said bottle through said first opening wherein said first pump is configured to selectively urge the fluid outwardly from said bottle, said first pump comprising:

a first plunger being removably coupled to said top wall of said bottle wherein said first plunger is configured to be selectively urged downwardly on said bottle, said first plunger extending into said first opening in said bottle, a first tube being fluidly coupled to said first plunger and extending downwardly into said interior of said bottle wherein said first tube is configured to selectively draw the fluid inwardly therein when said first plunger is urged downwardly, a bottom end of said first tube being spaced from a bottom surface of said interior of said bottle, and a first spout being coupled to said first plunger, said first spout having a distal end with respect to said first plunger, said distal end being open, wherein said distal end is configured to dispense the fluid outwardly therefrom when said first plunger is urged downwardly; and a second pump being movably coupled to said outer wall of said bottle wherein said second pump is configured to be manipulated, said second pump being in fluid communication with said interior of said bottle through said second opening wherein said second pump is configured to selectively urged the fluid outwardly from said bottle, said second pump being vertically spaced downwardly from said first pump, said second pump comprising:

a second plunger being removably coupled to said outer wall of said bottle wherein said second plunger is configured to be selectively urged laterally toward said outer wall, said second plunger extending into said second opening, a second tube being fluidly coupled to said second plunger and extending inwardly into said bottle wherein said second tube is configured to draw the fluid inwardly therein when said second plunger is urged toward said outer wall, said second tube curving downwardly from said second plunger to said bottom wall of said bottle wherein said second tube is configured to draw the entire volume of the fluid outwardly from said bottle, and a second spout being fluidly coupled to said second plunger, said second spout having a distal end with respect to said second plunger, said distal end of said second spout being open, wherein said distal end of said second spout is configured to dispense the fluid outwardly therefrom when said second plunger is urged toward said outer wall.

* * * * *